United States Patent [19]

Farlow et al.

[11] 4,095,643

[45] Jun. 20, 1978

[54] AGENT FEEDER FOR PIPE CASTING APPARATUS

[75] Inventors: Carl P. Farlow; Joel P. Sutherland; William E. Snow, all of Birmingham, Ala.

[73] Assignee: American Cast Iron Pipe Company, Birmingham, Ala.

[21] Appl. No.: 528,442

[22] Filed: Nov. 29, 1974

[51] Int. Cl.[2] ..... B22D 13/10; B22D 13/02

[52] U.S. Cl. ..... 164/301; 164/57; 164/114; 222/193; 222/200

[58] Field of Search ..... 164/14, 66, 20, 22, 164/72, 33, 114, 298, 299, 301, 57; 222/199, 200, 193; 118/310, 306, 311, 318, 317, 307, 321, 308

[56] References Cited

U.S. PATENT DOCUMENTS

| | | | |
|---|---|---|---|
| 1,963,146 | 6/1934 | Russell et al. | 164/114 X |
| 1,963,148 | 6/1934 | Russell et al. | 164/300 X |
| 1,982,762 | 12/1934 | Russell et al. | 164/72 X |
| 1,986,985 | 1/1935 | Stuart et al. | 164/72 X |
| 2,128,327 | 8/1938 | Russell et al. | 164/72 |
| 3,456,712 | 7/1969 | Schuh | 164/301 X |
| 3,570,716 | 3/1971 | Kirsanoff et al. | 222/193 X |

FOREIGN PATENT DOCUMENTS

| | | | |
|---|---|---|---|
| 729,434 | 7/1932 | France | 164/299 |

*Primary Examiner*—Francis S. Husar
*Assistant Examiner*—Gus T. Hampilos
*Attorney, Agent, or Firm*—Cameron, Kerkam, Sutton, Stowell & Stowell

[57] ABSTRACT

Apparatus is disclosed for feeding an inoculating or nucleating agent or particle to a trough of a pipe casting apparatus or beneath the surface of molten metal within a ladle. In particular, the agents are introduced by a hopper into a sealed chamber by selectively actuatable valves. A gas compatible with the agent to be used in the casting process, is introduced into the sealed chamber, whereby a relatively low pressure is established therein. An agent feeder, such as a vibratory feeder, is provided for directing a measured charge of the agent into a funnel leading to an outlet conduit. The pressure established within the chamber forces the agent through the conduit which is in turn connected to a delivery tube by which the agent is used to coat the mold surface directly or is fed into a stream of metal in a centrifugal tube casting apparatus. An outlet valve in the outlet tube is provided for selectively permitting the passage of the agent and gas mixture to the casting apparatus.

9 Claims, 7 Drawing Figures

AGENT FEEDER FOR PIPE CASTING APPARATUS

BACKGROUND OF THE INVENTION

1. Field of the Invention

This invention relates to agent feeders and in particular to those feeders adapted for use with pipe casting apparatus.

2. Description of the Prior Art

The production of cast iron and ductile iron pipe by a DeLavaud system incorporating permanent or semi-permanent metal molds and utilizing a centrifugal casting procedure, is well known in the art. Illustrative of such a system is the centrifugal casting apparatus as shown in U.S. Pat. No. 1,949,433, wherein there is described a pouring ladle for receiving the molten metal, such as iron, and for accurately pouring a predetermined amount of the molten metal within a predetermined length of time, into a fixed trough positioned on an incline to carry the molten metal to the metal mold contained within and rotated by a casting machine. Further, the casting machine is mounted on wheels to move along a track in a rectilinear motion, whereby the fixed trough may be inserted into and withdrawn from an opening within the casting machine. As shown in the U.S. Pat. No. 1,949,433, the casting machine includes a rotating, water-cooled metal mold for receiving the molten metal discharged from the end of the trough, as the casting machine is moved with respect to the trough's discharge end. Such casting machines are very complex and closely controlled through the use of timers, limit switches and pre-programmed pouring cycles.

Typically, the method of pouring a single pipe includes the following steps. First, the casting machine is moved along its track to a position whereat the fixed trough is fully inserted within the water-cooled metal mold and its metal mold is rotating at a predetermined speed. Next, the machine ladle is activated whereby it is lifted so that molten metal is discharged into the trough at a predetermined flow rate. A time delay is permitted in which the molten metal fills the trough and then, the casting machine is activated so that it moves at a predetermined rate until the fixed trough is removed from its opening. As the trough is drawn through the casting machine, the molten metal is discharged along the length of the metal mold as it is rotated, whereby a uniform thickness of the molten metal is deposited upon the interior surface thereof. The pouring rate and the travel rate of the casting machine determines the thickness of the resultant pipe cast. After the metal has solidified, the pipe is extracted from the mold, and the casting cycle, as described above, may be repeated.

Use of various agents within the casting process to effect the structure of the cast pipe is known. In particular, it is well known that the microstructure of cast iron and ductile iron (carbides, peralite, ferrite, etc.) is affected by the following factors: (1) its chemical content (for example, various agents such as C, Si, Mn, Mg, Cr. etc, may be added); (2) the cooling rate: and (3) the nucleating agents present. It is apparent that the addition of various chemical substances into the molten metal will produce various alloys determined by the intended use of the cast pipe. Further, the addition of nucleating agents prior to the casting of a pipe can produce dramatic changes in the as-cast structure of the pipe. For example, nucleating or inoculating alloys or agents such as Ferro-silicon, Calcium-silicon or graphite may be added to the molten cast iron at various points in its casting process. The inoculating agent can be added to the molten metal within the machine ladle, to the molten metal as it is poured from the machine ladle into the trough, or into the molten metal as it leaves the discharge end of the trough and before it is disposed upon the interior surface of the rotating metal mold. Alternatively, as shown in the above-noted U.S. Pat. No. 1,949,433, the inoculating or nucleating agent can be distributed over the inner surface of the rotating metal mold before the metal is poured, which process permits the inoculating agent to be dissolved in the molten metal and also to serve as an insulator between the molten metal and the relatively cold suface of the metal mold, whereby the processing time required for the molten metal to freeze is increased.

It is important to closely control the amount of the inoculating or nucleating agent. Typically, the amount of material used is in the order of 0.1% to 0.2% of the weight of the pipe cast. For example, for a 20 foot long 6-inch diameter pipe, the amount of the agent distributed over the mold surface would be in the order of 0.6 lb. to 1.2 total, or 0.015 lb. to .030 lb. per square foot of mold surface. A uniform distribution over the mold surface is absolutely required. If the distribution is uneven and a space of the mold receives insufficient or no inoculating material, the molded pipe may crack, and if too much agent is deposited, surface defects of sufficient magnitude may result to scrap the pipe.

A modern DeLavaud pipe casting machine can produce pipes at rates of 60-pipes-per-hour or greater, which means that the use of the inoculating agent must be essentially automatic as well as reliable. To keep up with production demands, various schemes have been attempted to achieve the rapid as well as substantially uniform distribution of the inoculating or nucleating agents onto the pipe mold. For example, in one known scheme the powdered inoculating or nucleating agent is placed in a second through (not to be confused with the first-mentioned trough for the molten metal), to be inserted along the full length of the molten metal trough and prior to the deposition of the molten metal onto the interior surface of the metal mold, tilting the second trough while the mold is rotating, whereby a substantially uniform distribution of the agent is achieved over the length of the metal mold. A variation of this technique is set out in U.S. Pat. No. 1,963,147 wherein a second trough for the powdered agent is provided in combination with a pipe having a plurality of jets formed along the length of the second trough to assist the feeding of the powdered agent to the metal mold. Both of these arrangements, require that the second trough be separately filled, thus effectively preventing the incorporation of such a method into an integrated, automatic pipe casting machine.

A further type of apparatus for feeding inoculant to the surface of a metal mold is shown in the afore-mentioned U.S. Pat. No. 1,949,433, whereby the powdered agent is fed at a measured rate into a suitable receptacle such as a funnel. The funnel is conventionally open to the atmosphere, but may be screened if desired to prevent contamination. The granular inoculating or nucleating agent is thus directed into a cylindrical passage wherein the agent is subjected to a relatively high veocity of air or gas by a venturi nozzle and is thereby conveyed through a conduit to the molten metal trough. The use of such an arrangement has several distinct disadvantages. First, very large quantities of compressed air or gas are required to convey the desired amount of agent to the end of the trough. Such a large quantity of air passing through the relatively small diameter of the jet results in high discharge velocities, which prevent uniform distribution of the agent over the surface of the metal mold and may result in displacement of particulate matter and/or molten metal from the mold surface. In addition, the high gas velocities cause extreme abrasion and/or corrosion problems of the conveying equipment as well as the metal mold. This abrasion problem is particularly significant in that the agents are typically very hard alloys, which, in powder form, are very abrasive. Further, the tube which delivers the inoculating or nucleating agent to the end of the molten metal trough is closed off at its end and has a series of small openings adjacent the closed end through which the agents must pass to reach the surface of the metal mold. The use of high-velocity gases to deliver the agent can result in excessive turbulence and/or build-up of powdery agent material which eventually causes these small openings to be plugged up. This results in an increase in back pressure making controlled agent delivery difficult, if not impossible. High velocity agent feeders are not in themselves easily controllable as to the rate at which the agents are fed to the mold surface and apparatus subject to back pressure variations in the delivery tube only adds to the problems of the manufacturing process.

A further type of agent feeder is shown in U.S. Pat. No. 1,963,148 wherein a pipe having a plurality of openings serves to introduce a relatively high velocity of gas into a mixing chamber into which a measured quantity of the agent is also introduced. A fine powder mixture of the high-velocity gas and the agent is formed and directed via a conduit having one end extending into the mixing chamber. A plurality of openings are provided along the length of the conduit and the conduit extends along the entire length of the molten metal mold whereby the fine powder mixture, under pressure, is directed at one time through the openings and onto the mold surface. This conduit is fixed in its relationship with the metal trough and is not withdrawable. The primary difficulties with such an agent feeding mechanism is that the rate of agent deposition is limited and that it is difficult to secure uniform disposition along the entire length of the pipe, due to the agent material settling out of the fine powder mixture. Further, the openings are subject to frequent plugging resulting in non-uniform application of the agents onto the mold.

SUMMARY OF THE INVENTION

It is therefore an object of this invention to provide a new and improved apparatus for feeding nucleating or inoculating agents useful in the treatment of molten metal.

It is a more particular object of this invention to provide a new and improved apparatus for feeding nucleating or inoculating agents useful in the treatment of molten metal, whereby these agents are conveyed with relatively low velocities of gas.

A further object of the present invention is to provide a new and improved apparatus for metered feeding of metal treatment agents in forming cast iron pipe wherein a uniform distribution of the agent onto the surface of a metal mold or the molten metal is affected with a reduction in the problems of the delivery gas displacing the particulate matter and/or molten metal material from the mold surface.

In accordance with these and other objects of the invention, the subject invention comprises a sealed metering chamber having a first, inlet conduit through which inoculating or nucleating agents are selectively introduced by a first valve. A second conduit and valve are provided for selectively introducing a pressurized gas compatible with the agents into the sealed chamber. A dispensing mechanism is disposed within the chamber to receive the agents and meters the flow thereof to a funnel connected to a third, exit conduit, in turn connected to a delivery tube. The measured charge of the agents is released selectivey by a third valve within the third conduit and applied by the delivery tube either to the inside wall of a mold or it is mixed with molten metal.

In particular, a relatively low pressure is established within the sealed chamber, whereby the measured charge of agent is directed through the delivery tube to effect a uniform distribution of the agent material. In the preferred embodiment of this invention, a suitable receptacle, such as a hopper, is disposed together with a vibratory feeder and agent receiving funnel within a sealed chamber.

In one illustrative embodiment of this invention, the outlet conduit from the pressurized chamber is connected to a delivery tube disposed beneath and along the length of a trough utilized for receiving and pouring the molten metal onto the inner surface of a metal mold that is moved relative to the discharge end thereof. At the end of the tube, a series of openings are provided through which the mixture of gas and agent is distributed relatively uniformly onto the interior surface of the metal mold or onto the poured molten metal, as the case may be. In one particular embodiment of this invention, the end of the delivery tube includes a first opening disposed in relatively close proximity to a closed end of the tube for discharging the agent therethrough onto the surface of the metal mold, and a series of smaller openings disposed therefrom and spaced along the length of the tube to permit gas, but not the agents, to escape from the tube. The delivery tube structure at the delivery end is in effect a nozzle which serves to reduce the gas pressure at the closed end of the tube in the vicinity of the discharge opening, thus preventing the blockage of the discharge opening while insuring a relatively low rate of gas discharge therefrom so that the agents are distributed relatively uniformly upon the surface of the metal mold without causing molten material and/or particulate matter to be blown off the mold surface.

In a still further embodiment of this invention, the outlet from the sealed metering chamber is coupled by a suitable flexible conduit to a lance capable of being inserted beneath the surface of the molten metal contained within the ladle. In this manner, an agent such as a desulphurizing or other highly reactive agent, may be introduced at a controlled rate into the molten material beneath its surface. Such an arrangement enables external desulfurization of metal directly in the transfer ladle, avoiding the necessity of transferring molten metal materials into special containers.

BRIEF DESCRIPTION OF THE DRAWINGS

These and other objects and avantages of the present invention will become more apparent by referring to the following detailed description and accompanying drawings, in which.

DESCRIPTION OF THE PREFERRED EMBODIMENTS

Figure 1:
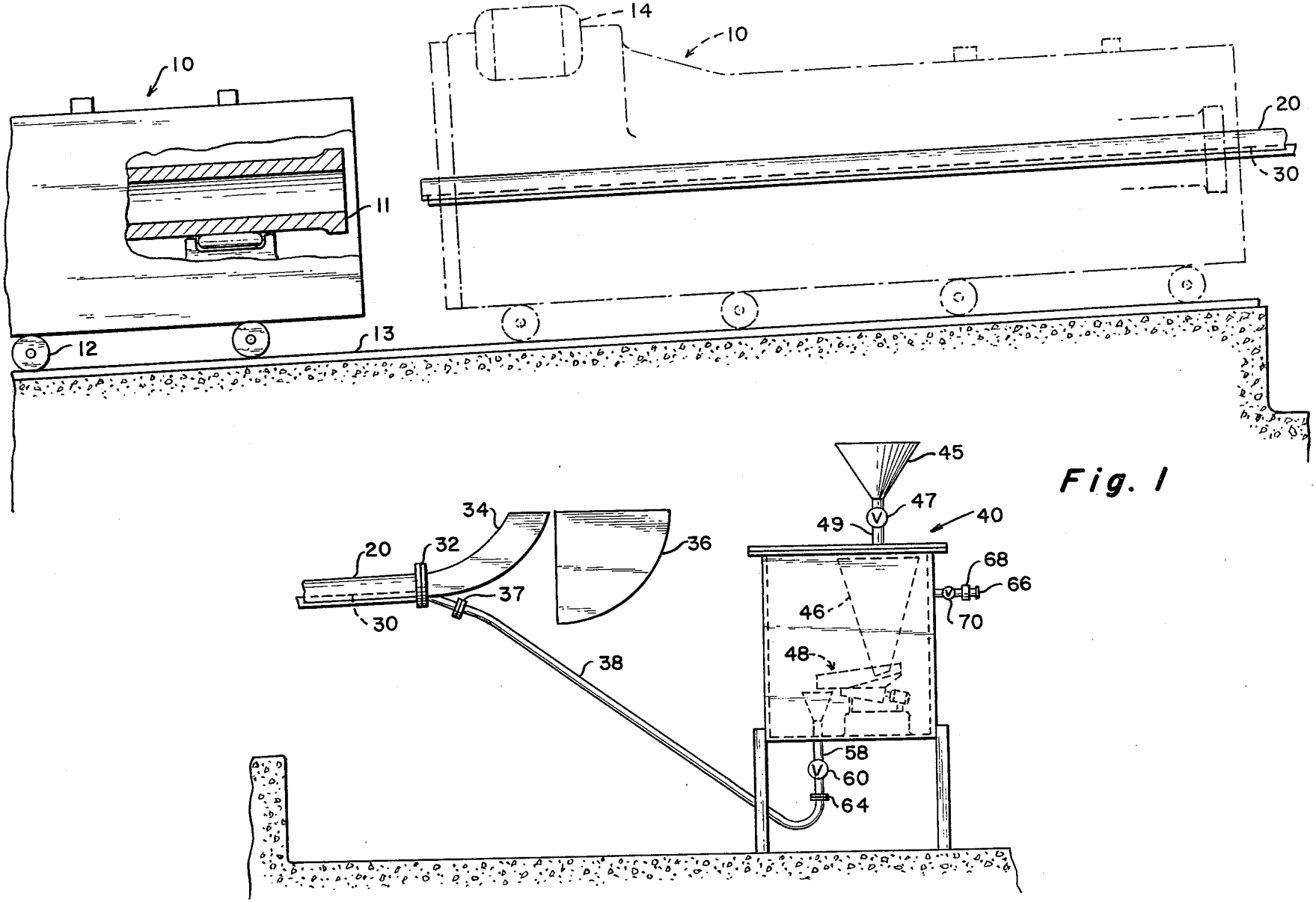
FIG. 1 is a view shown in two parts, of the agent feeder mechanism embodying the teachings of this invention, in combination with a conventional DeLavaud pipe casting machine.
Figure 4:
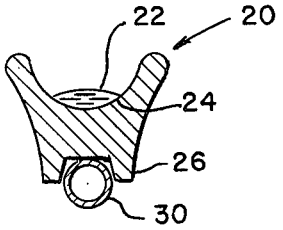
FIG. 4 is a cross-sectional view of the molten metal trough as incorporated into the system of FIG. 1.

With regard to the drawings and in particular to FIG. 1, there is shown a pipe casting machine 10 incorporating an agent feeder 40 in accordance with teachings of this invention. As shown, a casting machine 10 having a water-cooled mold therein driven rotatably by a motor 14, and being mounted upon wheels 12 to be guided along a track 13 between a first position shown in full line in FIG. 1 and a second position shown in dotted line, whereby a trough 20 is passed into and is removed from the metal mold within the casting machine 10. A delivery tube 30 associated with the trough 20 and preferably disposed in a grove in the underside of the trough serves to distribute an inoculating or nucleating agent along the interior surface of the metal mold and is coupled by a flange 37 to a hose 38. Hose 38 is made of a suitable flexible material such as rubber and is connected to the agent feeder 40, generally shown in FIG. 1 and shown in more detail in FIG. 2. Further, there is shown the machine ladle 36 for receiving the molten metal and capable of being lifted, i.e., rotated in a counterclockwise direction as shown in FIG. 1, whereby the molten metal is poured thereform along a funnel-like runner 34 into the trough 20. In FIG. 4, there is shown a cross-section of the trough 20 illustrating the manner in which a depressed surface 24 is formed within the trough 20 to receive the molten metal 22. Further, a pair of protrusions 26 form a groove or channel on the bottom side of the trough 20 and extending along its length, into which the pipe 30 is disposed and affixed.

As shown in FIG. 1, trough 20 is supported in a fixed position and is interconnected to the runner 34 by a flange 32. Both the runner and trough are supported to a suitable mechanism to enable their rotation 180° for dumping any excess or accumulation in the trough prior to running of the molten metal. Though not shown in FIG. 1, the structure for supporting the runner 34, as well as for controllably lifting and rotating the trough, runner and machine ladle 36, is well-known in the art.

Figure 2:
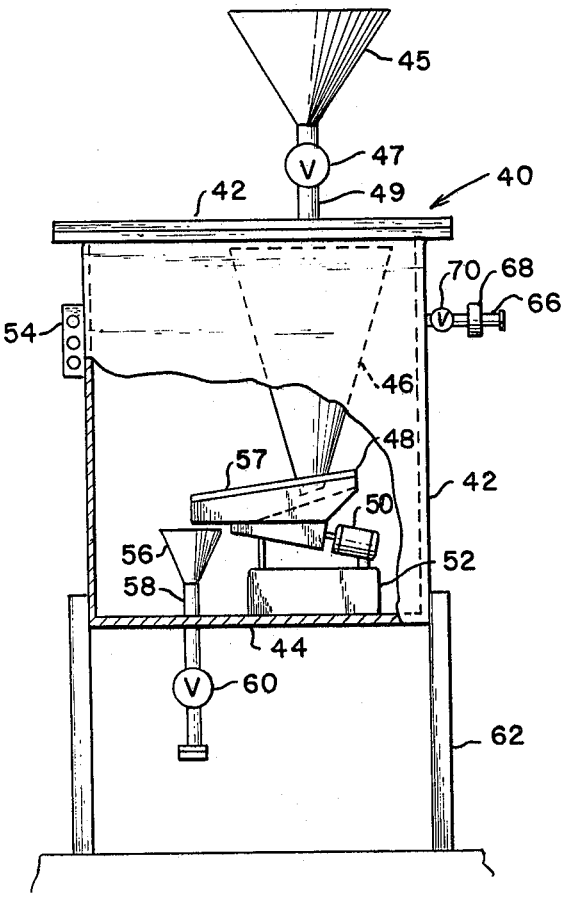
FIG. 2 is a further, detailed view of the agent feeder mechanism of this invention with a side wall of the sealed chamber partly broken away.

With refernce now to FIG. 2, there is shown the agent feeder 40 constructed in accordance with teachings of this invention, which includes a sealed chamber or tank 42 having a removable pressure-tight top 42 sealed to a flange of the chamber 42 as shown in FIG. 2, and a pressure-tight bottom 44 likewise secured in sealed fashion to the chamber 42. A first conduit 49 is inserted through a sealed opening within the chamber 42 to introduce selectively the inoculating or nucleating agent. In particular, there is shown a filling hopper 45 into which the agent is introduced. Solenoid controlled valve 47 is selectively actuatable by an electrical signal and is connected in conduit 49 and is operable to allow the agent to be introduced into the hopper 46 within chamber 42. A second conduit 66 is connected at one end to a suitable gas supply via valve 70. The gas supply must, of course, be compatible with the agent to be introduced into the molten metal. The other end of conduit 66 is coupled to the pressurized chamber 42. In particular, the second conduit 66 is connected to a supply (not shown) of pressurized gas, the precise pressure of which is controlled by a regulator 68. The pressurized gas is selectively introduced into the chamber 42 by valve 70 in response to a suitable electrical signal applied thereto. Preferably, in accordance with the preferred embodiment, the pressure within chamber 42 is maintained in the range of 10 to 15 psi. This enables the placement of the powdered or granular to be controlled very closely. Usually, the amount of material used would be in the order of 0.1% to 0.2% of the weight of the pipe cast. For a 6 inch diameter pipe 20 feet long, the amount distributed over the mold surface would be 0.6 lbs. to 1.2 lbs. total or 0.015 lbs. to 0.30 lbs. per square foot of mold surface. Uniform distribution over the mold surface is absolutely required in that not enough of the inoculating material can cause cracked pipes and too much can cause surface defects of sufficient magnitude to cause them to be scrapped.

Where larger pipes are employed which might require substantially greater amounts of inoculant, the pressure of chamber 42 is increased accordingly. Where lower amounts of inoculant are required, lower pressures could be utilized, but care should be taken not to reduce the pressure to such an extent as to disrupt the uniform distribution. Outlet conduit 58 is connected to the chamber through the bottom 44 and supports at one end within the sealed chamber a funnel 56. The agents are directed into funnel 56 and are selectively exited under the control of a solenoid operated control valve 60 which may be selectively actuated in response to an electrical signal applied thereto.

Within the pressurized chamber 42, there is disposed a reservoir or hopper 46 disposed beneath the opening of the conduit 49 to receive the inoculating or nucleating agent. The hopper 46 receives, holds and distributes the agent to a feeder 48 which feeds the agent at a measured rate directly into funnel 56 associated with outlet conduit 58. In an illustrative embodiment of this invention, the feeder 48 takes the form of a model FM-152 or FM-212 Feeder as manufactured by Syntron, a division of FMC Corporation, and described in their Instruction Manual No. F-503-A. Of course, other types of feeders may be employed within the sealed chamber. The significant feature of the invention is the use of the enclosed pressurized tank which permits the particulate material or agent to be delivered with a smaller volume of air than used in conventional open air delivery arrangements. The present invention enables the gas velocity in the delivery tank to be reduced thus avoiding the problem of particulate matter and/or molten metal displacement on the mold due to high air velocity.

Illustratively, the vibratory feeder 48 includes a tray 51 having a first end disposed beneath hopper 46 for receiving agents therein and a vibrating motor 50 which is energized at an appropriate rate to direct the agent along the tray 51 to one end thereof to be fed, as by gravity, into the funnel 56. As shown in FIG. 2, the vibratory feeder 48 is supported by a suitable mount 52 upon the bottom 44 of the tank 42. As explained above, with the third, exit valve 60 open, a measured charge of agent and gas mixture is permitted to flow from the conduit 58 to the discharge end of the tube 30, whereby it is discharged onto the interior surface of the metal mold.

In operation, the fill hopper is filled with a selected amount, e.g. 30–35 lb. of a granular inoculating agent, and upon opening the first valve 47, the inoculating agent is permitted to pass by way of conduit 49 to the prefill hopper 46 disposed within chamber 42. At this point, both the first and second valves 47 and 70 are closed, and after filling hopper 46, valve 70 is opened to pressurize the chamber 42.

With regard to FIG. 1, the casting machine 10 is actuated to initiate its movement from its downhill position towards its uphill position, i.e., to the right, as shown in FIG. 1. As the casting machine 10 starts uphill, a solenoid (not shown) is actuated to automatically open the third, exit valve 60, whereby the gas established under pressure within chamber 42, flows through the chamber and out through the funnel 56, conduit 58, flexible hose 38 and the small-diameter tube 30. Immediately after the third, exit valve 60 is opened, the vibratory feeder 48 is turned on, whereby a measured discharge of granular inoculating agent is made into the funnel 56. This agent is mixed with the compressed gas exiting through the funnel 56 and is conveyed through the conduits 58, hose 38 and pipe 30 to the end of the trough 20 where it is charged onto the inner surface of the rotating metal mold. At this time, the mold is being rotated whereby the granular agent is centrifugally held in place on its surface.

The agent feeder 40 is activated for that period of time required for the casting machine 10 to reach its maximum uphill position as shown in FIG. 1. Typically, the feeding of the powdered inoculant agent is terminated before the casting machine 10 reaches its uphill position by deactuating the vibratory feeder 48 and thereafter closing the third, exit valve 60. Whle the casting machine 10 is moving from its downhill to its uphill position, the machine ladle 36 is being lifted to pour the molten metal therein into the runner 34 to flow down the inclined trough 20 to be discharged from the remote end onto the rotating metal mold. In this manner, a uniform layer of molten metal is deposited about the surface of the mold and along its length. After the molten metal has filled the bell end of the metal mold, the casting machine 10 is actuated to move from its uphill to its downhill position and the agent feeder 40 is reactuated by first opening the third, exit valve 60 and thereafter, re-energizing the vibratory feeder 48. The agent feeder 40 is operated to continue to discharge the inoculant agents during the downhill movement of the casting machine 10 until just before the last of the molten metal leaves the trough 20.

There are significant benefits realized in the use of the invention described above. First, the inoculating or nucleating agents are delivered to the metal mold at a relatively low pressure and velocity of the gas transporting medium, whereby a more uniform distribution of the powdered inoculating agents is achieved and displacement of material is minimized.

Figure 5A:
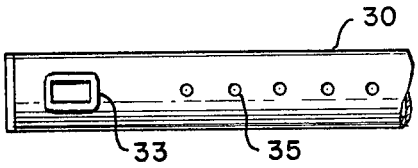
FIGS 5A and 5B respectively show a bottom and a cross-sectional view of the agent delivery tube as shown in FIG. 1.
Figure 5B:
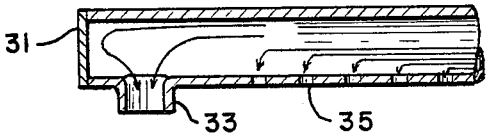

In this connection, the desired low pressure and low velocity of gas discharged from the pipe 30 is aided, in part, by the configuration of the discharge end of the pipe 30 as shown in FIGS. 5A and 5B. In particular, there is shown a discharge opening 33 through which the agents are discharged. The discharge velocity is relatively constant and dependent on the pressure established in chamber 42 and the size of the delivery pipe. As shown, the velocity and pressure of the carrier gas medium are partially dissipated by a series of openings 35 disposed along the length of the pipe 30 whereby the gas is partially bled therethrough. As a result, the agents are discharged through the opening 33 at a reduced velocity. As illustrated in FIGS. 5A and 5B, the openings 35 are of a reduced diameter with respect to that of the opening 33 to prevent the powdered agents from being discharged therethrough.

A further advantage of the agent feeder 40, as described above, is that it permits fully-automatic operation of the casting device. In particular, the vibratory feeder 48 is electrically energized, and therefore can be controlled to discharge varying amounts of agents depending on the rate of feed desired to be established and may be automatically stopped and started at any point during the casting cycle. As a result, the machine operator can add a predetermined amount of inoculating material to the mold at any time during the uphill and/or downhill movement of the casting machine.

The powdered agents distributed over the inner surface of the rotating metal mold serve at least two purposes: (1) they act as a nucleating or inoculating agent, and (2) they serve as an insulator between the molten metal and the inner surface of the metal mold. The insulating function is accomplished by the physical presence of the material between the molten metal and the interior surface of the mold and by the latent heat of fusion of the material as it is melted by the heat derived from the molten metal. The insulating function of the material affects the cooling rate of the cast pipe which in turn affects the "as-cast" grain structure thereof. Further, the insulation provided by the granular agents protects the metal mold from wear and lessens the thermal shock on it, thereby extending mold life.

Figure 6:
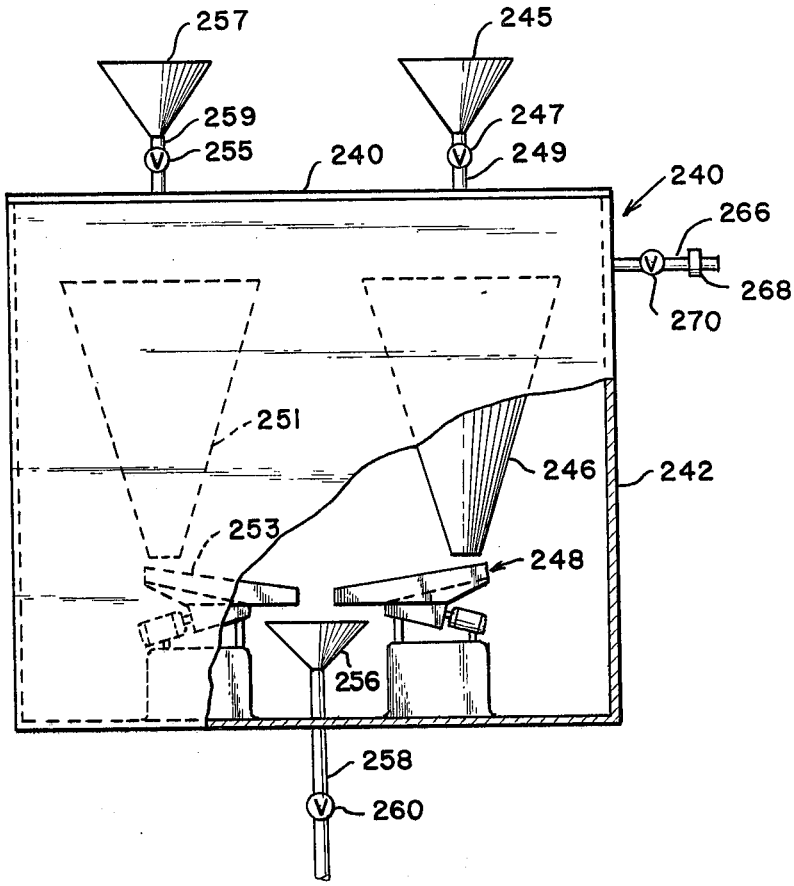
FIG. 6 is a cross-sectional view of an alternate embodiment of the invention wherein a pair of agent feeder mechanisms are employed so that more than one agent may be distributed in selected proportion to the molten metal.

Since one material may not combine the optimum properties of both inoculation and insulation, it is desired to be able to deposit at least first and second agents having respectively good insulating and good inoculating properties. Further, it is also desired to be able to control the deposition of either the first or the second agent at different times within the molding cycles. For example, it is desired to deposit the insulation agents close to the surface of the mold and to deposit the inoculating agents at the interface of the molten metal remote from the surface of the mold. To these ends, a multiple feeder arrangement is shown in FIG. 6, whereby first and second vibratory feeders 248 and 253 of the type as described above in connection with FIG. 2 may be incorporated within a single pressure-tight chamber 242. in FIG. 6, the various elements of the article feeder 240 are numbered with numbers similar in their last two digits to those numbers used in describing the feeder arrangement of FIG. 2, except that the numbers are placed in a 200-series. The general structure, as shown in FIG. 6, is similar to that as shown in FIG. 2 and further description will not be made.

In order to accommodate the use of a second vibratory feeder 253, there is also included a second inlet conduit 259 to permit the insertion of the second powdered agent, a fill hopper 257 coupled to the conduit 259 and a fourth valve 255 selectively actuatable to control the feeding of the second powdered agent into the chamber 242 and in particular into a second pre-fill hopper 251. As illustrated in FIG. 6, the second pre-fill hopper 251 is associated with the second vibratory feeder 253. The use of electrically energizable feeders 248 and 253 permits the selective discharge of the powdered agents, either independently or simultaneously, to the metal mold for selected periods of time corresponding to the properties of the powdered material and the desired properties of the cast pipe to be achieved by their addition.

in the operation of a multiple agent feeder 240, the first such feeder 248 is illustratively filled with a first or inoculating agent, whereas the second feeder 253 is filled with a second or insulating material. As the casting machine 10 is actuated to begin its movement toward its uphill position, the exit valve 260 is opened and the second vibratory feeder 253 is energized to begin discharging a measured amount of the insulating agent, previously filled within the pre-fill hopper 251. At a selected point during the "uphill" movement of the casting machine 10, the valve 260 is closed and the second vibratory feeder 253 is deactuated. Further, as the casting machine 10 starts in its "downhill" movement, the exit valve 260 is again opened and the first vibratory feeder 258 associated with the pre-fill hopper 246 filled with the inoculant agent is energized, whereby a measured amount of the inoculating agent is fed by the feeder 248 into the funnel 256 to be deposited as a layer of inoculating material on top of the previously-deposited layer of insulating material. At the end of the "downhill" translation, the first feeder 248 is deactuated and the second valve 260 is closed.

Figure 3:
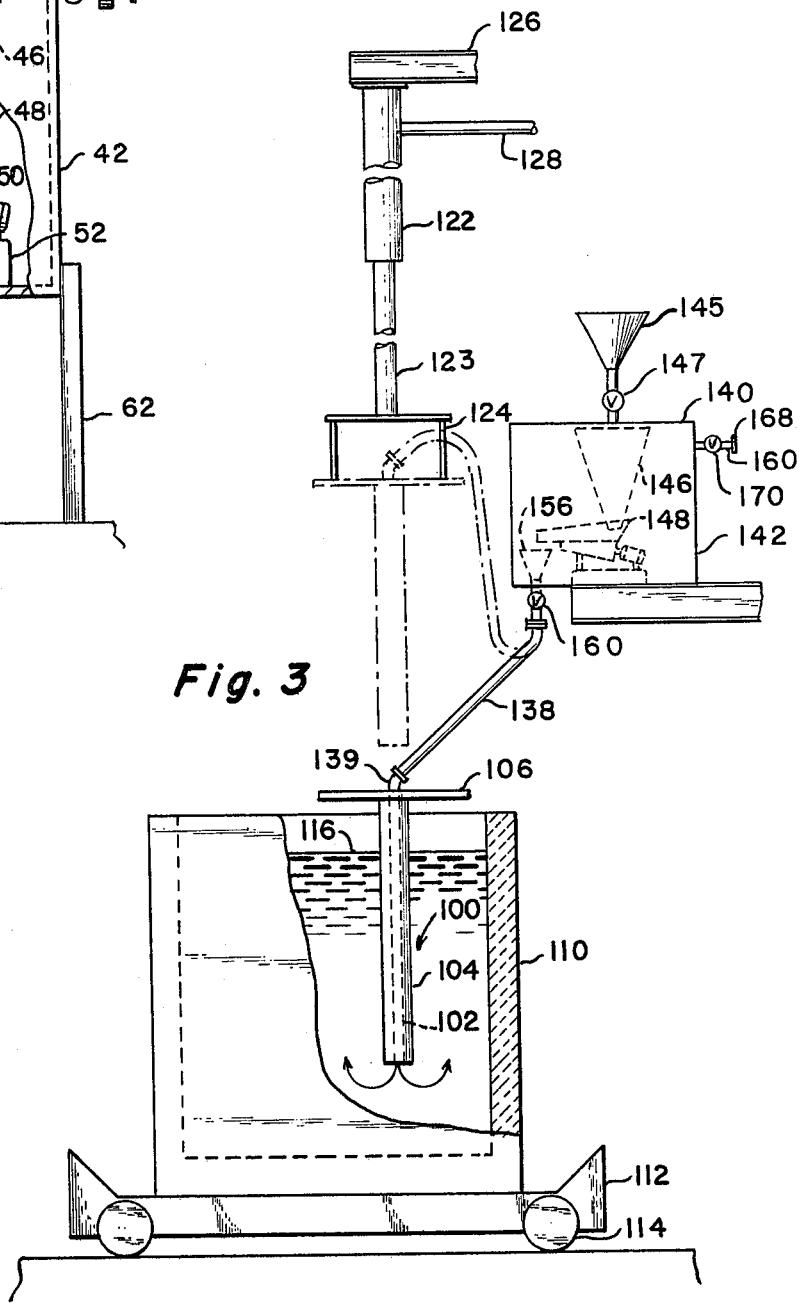
FIG. 3 shows the agent feeder mechanism of FIG. 2 in combination with a lance to be inserted beneath the surface of a molten metal contained within a ladle.

In addition to the powdered agents discussed above, additional agents may be added to the molten material for the following purposes: (1) to deoxidize the metal, (2) to desulphurize the metal, (3) to control grain size, and (4) to alloy with the molten metal. As discussed above, there are various methods for adding these agents to the metal. For example, these agents may be directed by a lance 102, as shown in FIG. 3, beneath the surface of the molten metal. This method is particularly effective where the additional agents are either highly reactive or less dense than the molten metal. Further, due to the relatively small size of the lance 102, it is relatively easy to insert the lance into the molten metal treatment and transfer car 110.

The injection device typically used in the prior art takes the form of a fluidized, pressurized hopper into which a mixture of the powdered agent and a complementary gas at high velocity is introduced by way of a refractory covered lance disposed beneath the surface of the molten metal. This type of injection introduces several problems related to relatively high hopper pressures and the consequent high-velocity gas flows. As a result, there is a temperature loss from the molten metal during treatment due to such high-velocity flows of gas. Further, such high-velocity flows of the gas medium tend not to be easily controllable and further tend to stop-up the exit orifice of the lance.

In FIG. 3, there is shown the use of an agent feeder 140 similar to that described above with respect to FIG. 2 in order to introduce at relatively low pressures and velocities a powdered agent beneath the surface of the molten metal as contained within the ladle 110. As shown, the ladle 110 is carried by a vehicle 112 mounted upon wheels 114. The parts of the agent feeder 140 are numbered with similar numbers to those used to identify the parts of the feeder 40 of FIG. 1 except that they are numbered in the 100-series and will not be further described at this point. The discharge of the article feeder 140 as derived from its conduit 158 is applied by a flexible hose 138 connected to the refractory covered lance assembly 100, at elbow 139. Elbow 139 is in turn connected to an inner lance 102 taking the form of a pipe of relatively narrow diameter through which the agents are introduced into the molten metal, and a refractory cover 104 of relatively larger diameter. Splash plate 106 is secured at the top of cover 104 and has attached thereto a suitable clamping mechanism 124 by which the lance is connected to the operating arm 123 of air cylinder 122.

As shown in FIG. 3, the refractory covered lance assembly 100 is disposed to a position within the molten metal upon actuation of air cylinder 122 from a suitable air supply (not shown), as shown in solid line and withdrawn to a second position as shown in dotted line when the air cylinder is deactuated. Cylinder 122 is suitably supported from an arm bracket 126 and may be connected to a suitable source of air pressure (not shown) via valved conduit 128 controlled to selectively plunge the refractory covered lance 100 into the molten metal. The extended arm 123 of air cylinder 122 is secured at its free end to a clamping mechanism 124, which is molded or bolted to splash plate 126 supporting the refractory covered lance 100, whereby it may be inserted and withdrawn from the molten metal upon operation of the air cylinder.

The pre-fill hopper 146 of the article feeder 140 is filled with the granular agents and a compatible gas is introduced by way of conduit 166 into the pressurized tank 142, as hereinbefore described. Suitable carrier gasses in addition to air include argon, nitrogen and carbon dioxide. With respect to air, either dry or wet air, i.e., air with water added to increase moisture control may be introduced under pressure within the chamber 142. When using wet air, however, greater care must be taken in that agents which readily absorb moisture, such as calcium carbide, would not be used.

After a ladle or transfer car 110 of molten metal has been positioned beneath the lance 100, the exit valve 160 is opened, allowing the pressurized gas within the chamber 142 to drive a measured discharge of the agents through the funnel 156, conduit 158, flexible hose 156 and lance 102, into the molten metal 116. The valve 170 remains open and the pressure within the tank 142 preferrably remains at a predetermined value in order of 10–15 psi as set by the gas regulator 168. However, as should be apparent, the pressure required within the tank may be greater depending upon the heighth of the molten metal above the discharge end of the lance. Immediately after the exit valve 160 is opened, the lance 102 is plunged beneath the surface of the molten metal 116. When the lance 102 has reached its maximum depth under the molten metal 116, the vibratory feeder 148 is energized, thereby introducing the granular agent into the funnel 156 whereby the compressed gas drives the measured discharge of agents through the lance 102 to be discharged into the molten metal. After a sufficient quantity of the particles has been so discharged for treatment of the metal, the vibratory feeder 148 is deenergized, and the lance 102 is retracted from the molten metal. The exit valve 160 remains open to permit the compressed gas to blow until the end of the lance 102 is cleared of the molten metal. At this time, the exit valve 160 is closed.

It is apparent by the use of the particle feeder 140 as described that the problems associated with high-velocity, high-pressure discharge of agents into molten metal are minimized and in particular, there is described means for providing a controlled discharge of agents at relatively low velocities and pressures, whereby the rate of discharge may be accurately controlled and the process may be selectively turned on and off.

Numerous changes may be made in the above-described apparatus and the different embodiments of the invention may be made without departing from the spirit thereof. For example, the feeding assembly described herein may be used to feed fluxing materials into a stream of metal in the centrifugal casting of steel tubes, wherein the molten metal is discharged into the mold at one end and not by a full length trough as described herein. Though particular agents and carriers have been described above, the feeding assembly may be used to provide a measured discharge of others including, but not limited to, the injection of granular code, coal, flux, silicon-carbide, calcium carbide or other solid particles through the tuyeres of a cupola or blast furnace. Further, it is contemplated that the feeding assembly described herein may be used to inject solid agents into molten metals for purposes of desulfurizing, degasing, alloying and removal of entrained slag, or further, to entrain abrasive mayerials into a moving air or gas flow for purposes of grit or sand blast cleaning. Therefore, it is intended that all matter contained in the foregoing description and in the accompanying drawings shall be interpreted as illustrative and not in a limiting sense.

We claim:

1. Apparatus for casting pipe comprising:

(a) a rotatable mold;

(b) a trough for delivery of molten metal from a source thereof to the interior of said mold;

(c) means for imparting a relative motion between said rotatable mold and said trough, whereby the molten metal is discharged from a discharge end of said trough as said trough moves with respect to said mold;

(d) a tube supported in a fixed relationship with respect to said trough for delivery of a mixture of solid, fine agents to said discharge end of said trough, whereby the fine agents are delivered to the interior of said mold; said tube having an inlet and an outlet;

(e) a feeder assembly for providing a measured charge of the solid, fine agents to said tube inlet and including a pressure-tight chamber, a first agent-introducing conduit and associated first valve means for selectively regulating the introduction of the fine agents into said chamber, a second gas-introducing conduit and associated second valve means for selectively introducing pressurized carrier gas within said chamber, and maintaining the pressure within said chamber in the range of 10 to 15 psi, feeding means disposed within said chamber including a first hopper positioned to receive the introduced fine agents, a first vibratory sloped try disposed beneath said hopper and selectively energizable for controlling the rate of flow of the charge of the agents at a measured rate, and a third exit conduit disposed to receive the measured charge of particles and associated third valve means for selectively controlling the flow of the mixture of the measured charge of agents and the carrier gas to said tube inlet.

2. The pipe casting apparatus as claimed in claim 1 wherein said feeder assembly includes a third agent-introducing conduit and associated third valve means for selectively regulating the introduction of agents into said chamber, and said feeding means disposed within said chamber includes a second hopper positioned to receive the agents introduced into said chamber from said third conduit, a second vibratory sloped tray disposed beneath said second hopper and selectively energizable to provide a measured charge of said agent and said third exit conduit being positioned with respect to said sloped trays so as to form a common discharge outlet for said agents.

3. The pipe casting apparatus as claimed in claim 2 wherein said first and said second trays each has one end disposed beneath its associated hopper and the other end disposed above a funnel connected to said third exit conduit, said trays being downwardly sloped and facing inwardly of said chamber so as to direct the agents fed at said one end along the tray to the other end as said trays are vibrated and by gravity into said funnel.

4. The pipe casting apparatus as claimed in claim 1 wherein said first tray is downwardly sloping and has one end disposed beneath said first hopper and its second end disposed above a funnel connected to said third exit conduit so as to direct the measured charge of agents by gravity into said funnel.

5. The pipe casting apparatus as claimed in claim 2 wherein said first and said second vibratory tray are connected to a first and a second motor, respectively, said motors being disposed within the pressure-tight chamber.

6. The pipe casting apparatus as set forth in claim 5 wherein each of said motors is connected to be independently energizable to enable independant vibration of each tray relative to the other tray.

7. Apparatus for casting pipe comprising:

(a) a rotatable mold;

(b) a trough for delivery of molten metal from a source thereof to the interior of said mold;

(c) means for imparting a relative motion between said rotatable mold and said trough, whereby the molten metal is discharged from a discharge end of said trough as said trough moves with respect to said mold;

(d) a tube supported in a fixed relationship with respect to said trough for delivery of a mixture of solid, fine agents to said discharge end of said trough, whereby the fine agents are delivered to the interior of said mold; said tube having an inlet and an outlet;

(e) a feeder assembly for providing a measured charge of the solid, fine agents to said tube inlet and including a pressure-tight chamber, a first agent-introducing conduit and associated first valve means for selectively regulating the introduction of the fine agents into said chamber, a second gas-introducing conduit and associated second valve means for selectively introducing pressurized carrier gas within said chamber, and maintaining the pressure within said chamber in the range of 10 to 15 psi, feeding means disposed within said chamber including a first hopper positioned to receive the introduced fine agents, a first vibratory sloped tray disposed beneath said hopper and selectively energizable to provide the measured charge of the agents, a third exit conduit disposed to receive the measured charge of particles and associated third valve means for selectively controlling the flow of the mixture of the measured charge of agents and the carrier gas to said tube inlet and (f) said tube outlet including a main discharge opening immediately adjacent an end thereof for permitting a flow of the mixture of the fine agents and gas therethrough, and a plurality of openings disposed from said discharge opening remotely of said end of said conduit for permitting the escape of the gas therethrough, whereby the pressure and velocity of the mixture flow through said discharge opening is reduced each of said plurality of openings being of reduced diameter with respect to the diameter of the main opening.

8. Apparatus for casting pipe comprising:

(a) a rotatable mold;

(b) a trough for delivery of molten metal from a source thereof to the interior of said mold;

(c) means for imparting a relative motion between said rotatable mold and said trough, whereby the molten metal is discharged from a discharge end of said trough as said trough moves with respect to said mold;

(d) a tube supported in a fixed relationship with respect to said trough for delivery of a mixture of solid, fine agents to said discharge end of said trough, whereby the fine agents are delivered to the interior of said mold; said tube having an inlet and an outlet;

(e) a feeder assembly for providing a measured charge of the solid, fine agents to said tube inlet and including a pressure-tight chamber, a first agent-introducing conduit and associated first valve means for selectively regulating the introduction of the fine agents into said chamber, a second gas-introducing conduit and associated second valve means for selectively introducing pressurized carrier gas within said chamber, and maintaining the pressure within said chamber in the range of 10 to 15 psi, feeding means disposed within said chamber including a first hopper positioned to receive the introduced fine agents, a first vibratory sloped tray disposed beneath said hopper and selectively energizable to provide the measured charge of the agents, a third exit conduit disposed to receive the measured charge of particles and associated third valve means for selectively controlling the flow of the mixture of the measured charge of agents and the carrier gas to said tube inlet, (f) a third agent-introducing conduit and associated third valve means for selectively regulating the introduction of agents into said chamber, (g) said feeding means disposed within said chamber including a second hopper positioned to receive the agents introduced into said chamber from said third conduit, (h) a second vibratory sloped tray disposed beneath said second hopper and selectively energizable to provide a measured charge of said agent, (i) said third exit conduit being positioned with respect to said sloped trays so as to form a common discharge outlet for said agents and (j) said tube outlet including a main discharge open immediately adjacent an end thereof for permitting a flow of the mixture of the fine agents and gas therethrough, and a plurality of openings disposed from said discharge opening remotely of said end of said conduit for permitting the escape of the gas therethrough, whereby the pressure and velocity of the mixture flow through said discharge opening is reduced each of said plurality of openings being of reduced diameter with respect to the diameter of the main opening.

9. The pipe casting apparatus as claimed in claim 8 wherein said first and said second trays each has one end disposed beneath its associated hopper and the other end disposed above a funnel connected to said third exit conduit, said trays being downwardly sloped and facing inwardly of said chamber so as to direct the agents fed at said one end along the tray to the other end as said trays are vibrated and by gravity into said funnel.

* * * * *

UNITED STATES PATENT AND TRADEMARK OFFICE

CERTIFICATE OF CORRECTION

PATENT NO. : 4,095,643

DATED : June 20, 1978

INVENTOR(S) : Carl P. Farlow et al

It is certified that error appears in the above-identified patent and that said Letters Patent are hereby corrected as shown below:

Claim 1, line 62, "try" should read --tray--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*